US006390112B1

(12) United States Patent
Christiansen

(10) Patent No.: US 6,390,112 B1
(45) Date of Patent: May 21, 2002

(54) TENT DOOR/DOOR FRAME STRUCTURAL UNIT PERMANENTLY ATTACHED AROUND A TENT'S WALL OPENING AND WHICH FOLDS AROUND A ROLLED UP TENT

(76) Inventor: Lyle J. Christiansen, 701 Imperial Dr., Morris, MN (US) 56267

( * ) Notice: Subject to any disclaimer, the term of this patent is extended or adjusted under 35 U.S.C. 154(b) by 0 days.

(21) Appl. No.: 09/785,610

(22) Filed: Feb. 16, 2001

(51) Int. Cl.[7] ..... E04H 15/48

(52) U.S. Cl. ..... 135/143; 135/121; 135/114; 135/153; 135/157; 160/88.06; 160/116; 160/180

(58) Field of Search ..... 135/143, 121, 135/114, 115, 157, 152, 153; 52/213, 656.7; 49/501, 208, 226; 160/84.06, 84.01, 180, 116

(56) References Cited

U.S. PATENT DOCUMENTS 1,636,507 A * 6/1927 Goodman ..... 135/119
1,699,094 A * 1/1929 Chadirjian et al. ..... 135/115
1,989,657 A * 1/1935 McCloud ..... 160/116
3,169,543 A * 2/1965 McGerty ..... 135/152
3,513,862 A 5/1970 Pohl ..... 135/14
4,067,346 A * 1/1978 Husted ..... 135/153
4,077,418 A * 3/1978 Cohen ..... 135/118 X
5,231,809 A 8/1993 Benjamino ..... 52/213
5,740,641 A * 4/1998 Oxnard ..... 160/209 X
6,227,281 B1 * 5/2001 Martin ..... 160/201

* cited by examiner

*Primary Examiner*—Carl D. Friedman
*Assistant Examiner*—Winnie Yip

(57) ABSTRACT

A tent door is hinged (44) and spring assisted to close the door and hold the door in a closed position against a bug-stopping weather-strip (18) attached to the surface of a door stop along the inside perimeter of a door frame. After entering or exiting a tent, a latch (74) on the inside surface of a door is needed only for security reasons. A tent door/tent door frame unit can be permanently attached around a tent's wall opening allowing the unit to fold around and with a rolled up tent. Folding of the unit is permitted by the removal of rigidity poles (61) from backbone columns (30). Because of the ease of entering and exiting a tent and of the convenience of folding the tent door/tent door frame unit around a rolled up tent, use of a tent so equipped becomes a pleasure.

17 Claims, 2 Drawing Sheets

TENT DOOR/DOOR FRAME STRUCTURAL UNIT PERMANENTLY ATTACHED AROUND A TENT'S WALL OPENING AND WHICH FOLDS AROUND A ROLLED UP TENT

CROSS-REFERENCE TO RELATED APPLICATIONS

Not applicable.

BACKGROUND—Field of Invention

This invention relates to entrance doors for tents.

BACKGROUND—Description of Prior Art

Entrance doors of tents are now generally of a zippered type. There are drawbacks and problems with them, especially when entering and exiting a tent many times during a short period of time. After awhile one tires of stooping, zipping, and unzipping. Sometimes the zippers stick and won't move and sometimes they pull apart.

The tent screen door in U.S. Pat. No. 3,513,862 to Pohl 1970, May 26 describes a knockdown rigid hinged door for a wall tent but it is complicated to manufacture because of its many parts and it has to be removed from a tent's wall and packed up for moving and then it has to be unpacked from the carrying case and attached to the tent wall when the tent is used again.

The screen door entry system in U.S. Pat. No. 5,231,809 to Benjamino and Poore Aug. 3, 1993 is similar to Pohl's patent in that it also must be attached to the tent wall for use and then removed from the tent's wall for packing.

Additional References

The tent described by Goodman U.S. Pat. No. 1,636,507 (1925) comprises a tent door which is of fabric and a tight joint is made by eyelets and lacings. A stick is placed in a hem at the bottom edge of the door flap to provide weight as well as for convenience in rolling up the door. It is not structural and would not supply the ease of entering and exiting a tent as a structural door does.

The tent described by Chadirjian U.S. Pat. No. 1,699,094 (1926) comprises doors formed in its front wall which is of a tent material and also not structural.

The door described by McCloud U.S. Pat. No. 1,989,657 (1932) relates to small pass doors through sectional doors of the overhead type. The pass door has three sections united to one another by hinges which permit it to roll up with the main sectional door. This door does not comprise means for making it first rigid then foldable, but of course its use is different than for doors in tents which are rolled up after use, for transport and storage.

The portable shelter of McGertv U.S. Pat. No. 3,169,543 (1962) describes a shelter which can be quickly collapsed into a compact package so as to enable it to be easily transported. It comprises various telescoping interfitting portions that collapse into each other. This telescoping idea is very different than the folding idea of the present invention.

A collapsible hunting blind of Husted U.S. Pat. No. 4,067,346 (1976) describes a door comprising a zipper on one panel of tent material that forms a flap opening through which a person gets in and out of the blind. In the current invention all zippers are illuminated and a structural door hinged to a door frame and weather stripped is provided.

A sectional door with roller shield apparatus is described by Martin U.S. Pat. No. 6,227,281 B1 (1999). It includes a plurality of door sections hingedly joined in an edge-to-edge relationship. But this door only folds backwards. It does not also swing open and shut like a conventional structural entrance door.

Oxnard U.S. Pat. No. 5,740,641 (1998) describes a self storage facility having insulated storage rooms, each room having an exterior foldable door. But it is not capable of being folded up with its door frame.

OBJECTS AND ADVANTAGES

Accordingly, when a tent door/door frame unit is permanently attached around a tent's wall opening it allows ease in erecting and taking down a tent, and this unit:

(a) provides for a rigid unit to convert to a unit that folds and the unit conveniently folds around and with a rolled up tent;

(b) and provides a spring-assisted-hinged door that closes the door and holds it closed without the need of latching the door unless for security reasons;

(c) and provides a tent door that effectively seals out uninvited insect guests without the use of zipper closures;

(d) and provides for a rigid unit because of interconnecting backbone segments, rigidity poles, and strong materials in its construction.

"Further objects and advantages of my invention will become apparent from a consideration of my drawings and ensuing description."

REFERENCE NUMERALS IN DRAWINGS

12 backbone segment
14 base plate
16 threshold
18 bug-stopping weather strip
22 header/rain trough
23 flanges
24 hole
26 weld
27 frame segment
28 frame side
30 backbone column
32 framea's raised border
34 door stop/breech finger
36 bug-stopping weather strip segment
38 door segment
40 door's raised border
42 underside mortise
44 hinge segment
46 joint
48 tubular section
50 female open-ended box
52 male open-ended box
54 male open-ended box
56 open end
58 box sides
60 bottom plate
62 pointed end
63 blunt end
66 female inside threads
68 protruding plug with male threads
70 rigidity pole segment
72 door pull
73 security latch
76 magnifying peep hole
78 fabric
80 tie down

SUMMARY

In accordance with the present invention of a tent door hinged to a tent door frame wherein forms a unit that is structural and yet becomes roll-up-able by means of removable rigidity poles. Wherein said unit can be permanently attached to the fabric around a wall opening in a tent wherein the unit is then able to be folded around and with a rolled up tent.

DESCRIPTION—PREFERRED EMBODIMENT

A preferred embodiment of the parts of the present invention are shown in FIGS. 1–6.

The preferred material for construction of most parts is aluminum or magnesium, because these materials are lightweight, weatherproof, and strong.

Figure 1:
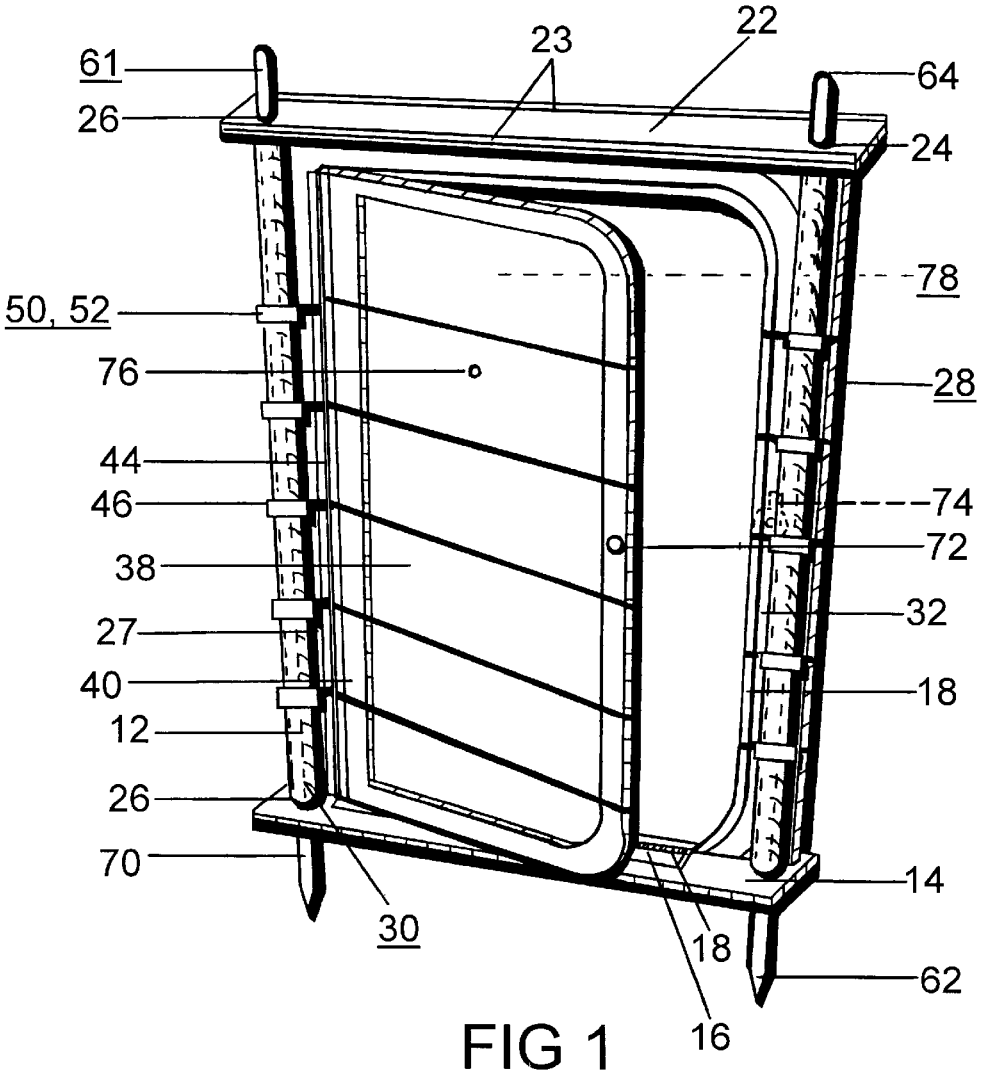
FIG. 1 shows a hinged door partially opened and interconnected with a door frame that has rigidity poles installed in backbone columns.

FIG. 1 (front view) shows a tent door/tent door frame unit with the door partially opened. The tent door frame comprises two sides 28, a base plate 14, and a header/rain trough 22. These parts are connected by welds 26 at the corners. The header/rain trough has vertical flanges 23 along its front and back widths. The door frame sides comprise multiple segments 27.

The door and the door frame's multiple-horizontally-adjacent segments have the same vertical length, therefore, a transversing joint 36 between the segments extends horizontally across the width of the tent door/tent door frame unit in a straight line. The tent door and the tent door frame unit's backside has a strong fabric 78 bonded to them which serves as hinges at the transversing joints. The unit presents a backside with a plane surface when the tent door is situated in the tent door frame.

A security latch 74 is located on the door frame's backside, approximately at the height of the door's front side door pull.

The tent door comprises multiple door segments 38 which are connected to the door frame segments by torsional-hinge segments 44 which are attached by bolts or screws along the unit's vertically-adjacent sides. A threshold 16 is attached to the surface of the base plate and a bug-stopping weatherstrip 18 is slidingly located in a recess along the width of the threshold. A door pull 72 is located on the door's raised border 40, on the door's leading edge, at a convenient height. A magnifying peep hole 76 is located at the horizontal center of a door's segment and at a convenient height.

Figure 2:
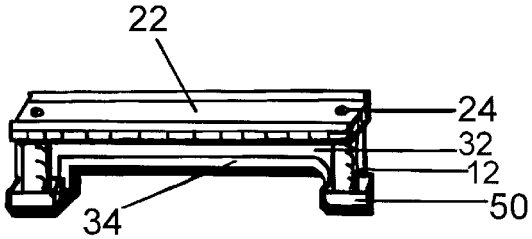
FIG. 2 shows a top door frame segment unit.

FIG. 2 shows a top-door-frame-segment unit comprising a top-frame segment 27 from each of the frame's sides. Each frame's side segment has a top backbone segment 12 attached to them by welds 26. A header/rain trough 22 is attached to the top frame segments by welds. There are holes 24 near the ends of the header/rain trough that are a size for a rigidity pole 61 to slidingly engage. These holes are in a perpendicular line with the backbone columns 30. The bottom door frame segment unit is similar to the top frame segment unit (FIG. 2) except it comprises a base plate across its bottom width (not illustrated).

Figure 3:
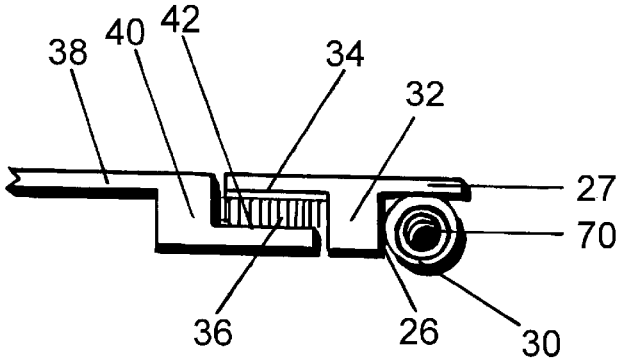
FIG. 3 shows a cross section of a closure connection of a door and a door frame.

In FIG. 3 (cross section view) the tent door frame interconnects with a tent door as shown. The frame has a raised border 32 with a door stop/breech finger 34. A bug-stopping weather strip segment 36 is bonded to the surface of the door stop. A backbone segment 12 (one of multiple-backbone segments that are vertically adjacent to each other and form a backbone column 30) is positioned alongside the raised border and attached by welds to the frame segments. A raised border 40 around the perimeter of the door, with its horizontal flange 42 is shown interconnecting with the bug stopping weather-strip segments 36 bonded to the surface of the frame's door stop.

Figure 4:
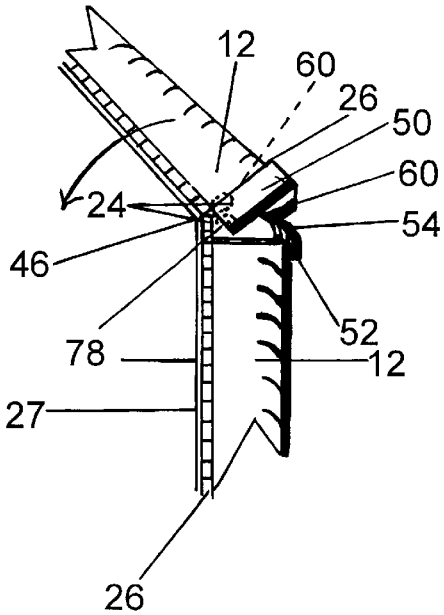
FIG. 4 shows a side view of an interconnecting-male-backbone segment connection with an adjacent interconnecting-female-backbone segment.

FIG. 4 (side view) shows two adjacent-backbone segments at a joint 46 between them. The two segments are shown folding forwards. A strong fabric is bonded to the frame's backside. The backbone segment is mainly tubular with male 52 and female open-ended boxes 50 attached to the ends of the tubular section 48 by welds 26. The male box is smaller than the female box and they slidingly interconnect. The boxes have an open side 56 facing the door frame. The male box side 58 which is opposite from the open side, is rounded 54 on its end. The boxes have bottom plates 60, with a hole bordering the frame side, through them that is a size of the tubular section. The bottom plates are attached to the tubular section, around the holes, by welds. The bottom plate of the female box has a box side 58 that extends towards an adjacent backbone segment and the male box has sides that extend away from an adjacent backbone segment. The female box sides which are adjacent to the frame are not attached to the frame by welds.

Figure 5:
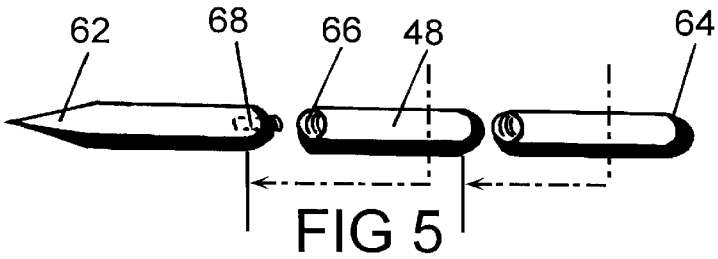
FIG. 5 shows a front view of a rigidity pole unassembled.

FIG. 5 shows a rigidity pole (one of two) with its multiple segments 70 separated. The pole's segments are tubular with female-inside threads 66 on one end and male-outside threads on a protruding plug 68 located in the tubular segments other end, except, the pole's top segment which has a blunt end 64 and the pole's bottom segment has a pointed end 62.

Figure 6:
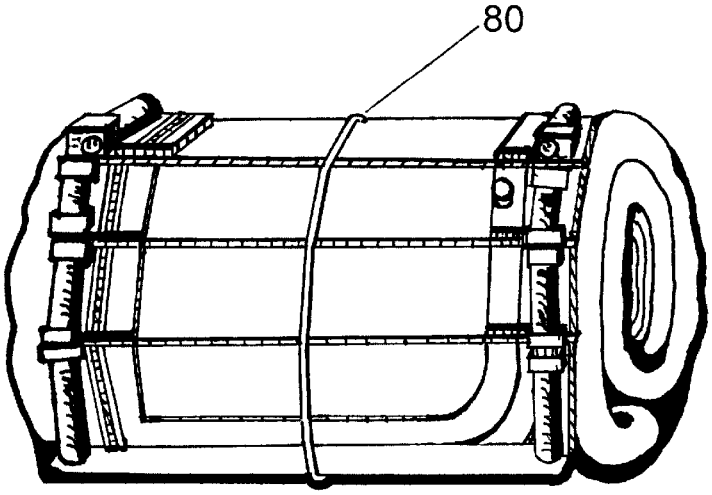
FIG. 6 shows a tent door/tent door frame unit folded around a rolled up tent.

FIG. 6 shows a tie down 80 and a door/door frame unit folded around a rolled up tent.

Additional Embodiments

A segmented backbone column could also be attached by welding to the leading edge of the tent door and its rigidity pole could be included to make an even more rigid door when the rigidity pole was inserted into the backbone column.

Screens or windows could be installed in the door segments.

The tent door/tent door frame unit would look pleasing with an olive drab finish to help it fit in with the color of most tent fabrics or it could have other colored finishes.

Alternative Embodiments

If frames were around all sides of a door segment, tent fabric could be installed within the frames.

Also windows or screens could be installed within the frames.

Advantages

From the description above, a number of advantages of my tent door/door frame unit become evident.

(a) A tent door that has no zippers, so described, frees one of the chore of stooping over and the unzipping and zipping up a tent door.

(b) A tent door that is assisted by springs to close and hold it against a door frame's door stop does not need to be latched every time one enters or exits a tent. Therefore entering or exiting becomes fast and easy. The tent door could still be latched for security reasons at times.

(c) A tent door/door frame unit which is permanently attached around a tent's wall opening shortens the time it takes to erect a tent and the time it takes to dismantle a tent and pack it up.

Operation—FIGS. 1–6

The manner of using and advantages of a permanently attached tent door/tent door frame unit are: the only effort needed to put the unit in service is to insert two rigidity poles 61 down through two backbone columns 30 and engage the pointed ends of the rigidity poles into anchoring holes in the ground. The former way of putting a structural tent door/door frame unit into service which isn't permanently attached is:

1. Remove the unit from its carrying case.
2. Assemble the unit, which has many parts.
3. Attach the unit to the tent wall opening, which takes some doing.

Then before leaving camp:

4. Remove the unit from the tent.
5. Disassemble the unit.
6. Pack it into its carrying case.

The current invention may be permanently attached around a tent's wall opening by bonding the backside of the tent door frame to the tent fabric with a strong yet flexible bonding agent. The unit's backside has a plane surface when the tent door is situated in the tent door frame. This plane surface is what permits the unit to fold forwards toward the tent.

A way of folding a structural tent door/tent door frame unit, which is permanently attached around a tent's wall opening, becomes possible because the tent door and the tent door frame comprise adjacent segments that are the same linear height. A transversing joint 46 then extends in a straight line across the width of the unit. A strong fabric 78 is bonded to the backside of the door to interconnect with the segments (the tent fabric that's around the wall opening in a tent is bonded to the backside of the frame). The fabric serves as a hinge along the transversing joints. These hinges permit the unit to fold forwards towards the tent at the joints and permit the unit to fold around a rolled up tent (FIG. 6).

But how can this folding tent door/tent frame unit be made rigid for use in a simple way? Answer: this is accomplished by the insertion of two rigidity poles. The unit must be rigid in order for the door to close against a door stop and effectively stop insects from entering a tent. What parts do the rigidity poles engage through? Answer:

1. Holes in the ends of the header/rain trough 22,
2. The tubular backbone column 30 which is attached to the frame segments by welds 26,
3. And holes in the ends of the base plate 14.

The rigidity pole (FIG. 3) comprises multiple tubular sections 48 with female inside threads 66 on one end and male outside threads 70 on a protruding plug on its other end. When this pole is assembled there are no ridges on the pole to prevent it from slidingly being inserted in the holes in the header/rain trough, the base plate, and the backbone column.

Rigidity is further increased by means of welds that attach the two top frame segments 27 and two top backbone segments 12 (FIG. 2) to the header/rain trough ends and that attach the two bottom frame segments and two bottom backbone segments to the base plate.

The tent door/tent door frame unit is prevented from twisting by the interconnecting square boxes of the male 52 and 50 female open-ended connections. The boxes are located on opposite ends of backbone's tubular sections 48. The bottom plates 60 of the boxes have a hole through them which borders the frame, through which the rigidity pole slides. The backbone column's segments are attached to the frame segments by welds.

The male and female box construction permits the folding of the adjacent backbone segments by their open ends 56 that are adjacent to the frame. The male box's side opposite its open end has a rounded end 54 to allow the box to fold into the female box without binding. The bending action of a knee describes this action.

(FIG. 3) To provide a door with door segments 38 that have no play at the hinges, a piano type hinge is preferred. The hinges are also in segments 44 which allows the door to fold forward with the frame when the rigidity poles are removed. The hinges have torsional springs which put force on the door to close it and hold it closed against the frame's door stop with its attached bug-stopping weather-strip 36.

To provide a tent door/tent door frame unit, that with the door closed seals out uninvited insect guests, the frame comprises:

1. A bug-stopping weather-strip attached by a bonding agent to the surface of a door stop 34.
2. A bug-stopping weather-strip slidingly engaged in a recess in the threshold 16 which extends across the full width of the threshold.
3. The weather-strip on the door stop of the frame's sides are in segments to allow the frame to fold forward. The threshold is attached to the base plate by bolts or screws.

CONCLUSIONS, RAMIFICATIONS, AND SCOPE

Accordingly, the reader will see that a tent door/tent door frame unit such as described can be permanently attached to a tent's fabric around a tent's wall opening, therefore simplifying the task of erecting and dismantling it.

A tent, which utilizes a hinged tent door which one pulls open when entering and then, which closes by spring assisting hinges and is held against a bug-stopping weather-strip, becomes a pleasure to use. There is no need to latch the door every time one enters or exits.

With the simple action of sliding two rigidity poles from the backbone segments, the tent door/door frame unit becomes able to be folded around and with a rolled up tent.

Such a unit permits fast and easy entering and exiting from tents.

Such a unit lessens problems for those using tents. Zippered tent doors often become difficult to use because the zipper breaks or it pulls loose from a tent wall.

Although the description above contains many specifics, these should not be construed as limiting the scope of the invention but as merely providing illustrations of some of the presently preferred embodiments of this invention. For example: the drawing in FIG. 1 shows a rectangular shaped door with rounded leading corners when it could have a square shape if the door was for a small tent and the tent could have right angle corners on its leading door corners.

Thus the scope of the invention should be determined by the appended claims and their legal equivalents, rather than by the examples given.

I claim:

1. A tent door/tent frame unit comprising:

(a) a unit which has structural frame members that present a unit with a plane rear surfaced, said frame members including two vertical side members and a central opening, each said vertical side member having multiple vertically-adjacent segments;

(b) said plane rear surface wherein comprises a first fabric material for attachment of a tent structure, said first fabric material attached to said structural frame members which serves as hinges for hingedly connecting said multiple vertical-adjacent segments of the vertical side members;

(c) a tent door having multiple vertical-adjacent segments being horizontally hinged together by a second bonded fabric material;

(d) one side of said vertical-adjacent segments of the tent door being hingedly connected to said multiple vertical-adjacent segments of one of the vertical side member of the structural frame members by torsional hinges for opening and closing the central opening of the unit;

(e) and removable rigidity poles providing means for enabling the unit to be either rigid when in use or to fold with the tent when for transporting by the sliding of said rigidity poles in or out of unit.

2. The tent door/tent door frame unit of claim 1, which said unit comprises a raised border with an underside mortise around a perimeter of said tent door.

3. The tent door/tent door frame unit of claim 1, in which said unit comprises a raised border around a perimeter of said tent door frame.

4. The tent door/tent door frame unit of claim 3, further comprises a breech finger around an inside perimeter of said raised border of said tent door frame.

5. The tent door/tent door frame unit of claim 4, in which said breech finger serves as the tent door stop.

6. The tent door/tent door frame unit of claim 5, in which said tent door stop comprises a weather-strip attached to its surface.

7. The tent door/tent door frame unit of claim 5, in which said multiple vertical-adjacent segments of said tent door having a same length as said multiple vertical-adjacent segments of the tent door frame.

8. The tent door/tent door frame unit of claim 1, in which said unit further comprises:

(a) a multiple vertical adjacent backbone segments attached to multiple vertical-adjacent segments of said side members of said tent door frame by means of welds.

(b) a bottom tent door frame segment unit comprising two of said tent door frame segments and two of said backbone segments at the bottom ends of two side members of the tent door frame, attached by means of welds to two ends of a base plate which extends horizontally between said two side members of the tent door frame.

(c) a top tent door frame segment unit comprising two of said tent door frame segments and two of said backbone segments at the top ends of two side members of the tent door frame, attached by means of welds to two ends of a header with rain trough extending horizontally between said two side members of the tent door frame.

9. The tent door/tent door frame unit of claim 8, in which said base plate comprises:

(a) a threshold attached to said base plate's surface by a fastening means such as bolts or screws, (b) and a weather-strip located in a recess of said threshold which extends for the width of the threshold.

10. The tent door/tent door frame unit of claims 9, in which said rigidity pole comprises:

(a) multiple segments with female threads inside one end of said multiple segments and male threads, on a solid plug, protruding from the segment's other end, (b) and a top end of an upper segment of each said rigidity pole having a blunt end, and a bottom end of a lowest segment of each said rigidity pole having a pointed end.

11. The tent door/tent door frame unit of claim 9, in which said backbone segments comprises:

(a) tubular sections, (b) male and female open-ended boxes attached by means of welds to the ends of each tubular section, (c) and said multiple vertically adjacent backbone segments form backbone columns.

12. The tent door/tent door frame unit of claim 11, in which said male and female open-end boxes comprise:

(a) a male box which is smaller than a female box, (b) said male and female boxes comprising an open side that faces the tent door frame, (c) said male boxes having an opposite rounded side, (d) and said open-ended boxes each comprising a bottom plate with a hole through it and said hole is a size of an outside diameter of said tubular section of said backbone segment and said hole's perimeter is attached to the tubular section ends by means of welds.

13. The tent door/tent door frame unit of claim 12, in which said bottom plate of said female box comprises box sides attached by welds which extend toward an adjacent said backbone segment.

14. The tent door/tent door frame unit of claim 12, in which said bottom plate of said male box comprises box sides attached by welds which extend away from an adjacent said backbone segments.

15. The tent door/tent door frame unit of claim 11, in which said removable tubular rigidity poles being removably located within the backbone column's tubular section and through holes which are located near the ends of the base plate and near the ends of the header or rain trough.

16. The tent door/tent door frame unit of claim 15, in which said holes are located in a perpendicular straight line.

17. The tent door/tent door frame unit of claim 1, in which said structural frame members constructed of a lightweight, strong material such as aluminum.

* * * * *